US011118796B2

(12) United States Patent
Koike et al.

(10) Patent No.: US 11,118,796 B2
(45) Date of Patent: Sep. 14, 2021

(54) OUTDOOR UNIT FOR AIR CONDITIONER

(71) Applicant: DAIKIN INDUSTRIES, LTD., Osaka (JP)

(72) Inventors: Fumiaki Koike, Osaka (JP); Daiki Hirawa, Osaka (JP); Yuusuke Tanaka, Osaka (JP); Takashi Tsujiuchi, Osaka (JP); Shigeki Kamitani, Osaka (JP); Takuya Horita, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/941,923

(22) Filed: Jul. 29, 2020

(65) Prior Publication Data

US 2020/0355376 A1 Nov. 12, 2020

Related U.S. Application Data

(63) Continuation of application No. PCT/JP2018/043128, filed on Nov. 22, 2018.

(30) Foreign Application Priority Data

Jan. 31, 2018 (JP) ..... JP2018-015458

(51) Int. Cl.
*F24F 1/16* (2011.01)
*F24F 1/56* (2011.01)
*F24F 13/30* (2006.01)

(52) U.S. Cl.
CPC ..... *F24F 1/16* (2013.01); *F24F 1/56* (2013.01); *F24F 13/30* (2013.01)

(58) Field of Classification Search
CPC ..... F24F 1/16; F24F 13/30; F24F 1/56
See application file for complete search history.

(56) References Cited

U.S. PATENT DOCUMENTS 4,748,827 A * 6/1988 Chang ..... F28F 9/013 62/272
7,210,305 B2 5/2007 Shin
(Continued)

FOREIGN PATENT DOCUMENTS

EP 2354683 A2 * 8/2011 ..... F24F 1/50
EP 2995873 A2 3/2016
(Continued)

OTHER PUBLICATIONS

International Search Report issued in International Application No. PCT/JP2018/043128, dated Feb. 5, 2019 (5 pages).
(Continued)

*Primary Examiner* — Kun Kai Ma
(74) *Attorney, Agent, or Firm* — Osha Bergman Watanabe & Burton LLP

(57) ABSTRACT

An outdoor unit for an air conditioner includes: a casing including a bottom plate that defines a bottom surface of the casing; a heat exchanger disposed in the casing; and an installation foot that supports the bottom plate from below. The installation foot includes: a support portion that supports from below an end portion of the bottom plate, a wall portion disposed on an outer side of the end portion of the bottom plate and that extends upward from the support portion, and a mount portion that extends from an upper end of the wall portion. The heat exchanger is mounted on the mount portion. The mount portion has a hole that extends through the mount portion in a height direction of the outdoor unit.

6 Claims, 4 Drawing Sheets

(56) References Cited

U.S. PATENT DOCUMENTS

| | | | | |
|---|---|---|---|---|
| 2003/0217563 | A1* | 11/2003 | Wendt | F24F 1/18 62/298 |
| 2004/0111982 | A1* | 6/2004 | Lattanzio | F24F 13/20 52/64 |
| 2005/0000239 | A1* | 1/2005 | Ishihara | F24F 1/50 62/298 |
| 2005/0034471 | A1* | 2/2005 | Shin | F24F 13/222 62/285 |
| 2005/0150247 | A1* | 7/2005 | Ishihara | F24F 1/26 62/507 |
| 2007/0169498 | A1* | 7/2007 | Rios | F28F 17/005 62/285 |
| 2009/0107161 | A1* | 4/2009 | Jang | F24F 1/56 62/259.1 |
| 2014/0298844 | A1* | 10/2014 | Luo | F24F 1/18 62/275 |
| 2014/0339968 | A1* | 11/2014 | Nakagawa | F24F 1/50 312/100 |
| 2015/0000321 | A1* | 1/2015 | Kagawa | F24F 1/50 62/291 |
| 2016/0076779 | A1* | 3/2016 | Lee | F24F 1/10 62/508 |
| 2016/0076796 | A1* | 3/2016 | Lee | F24F 1/46 62/498 |
| 2016/0195343 | A1* | 7/2016 | Jeung | F24F 1/50 165/162 |
| 2017/0314791 | A1 | 11/2017 | Yanase et al. | |
| 2018/0266723 | A1* | 9/2018 | Mori | F24F 1/00 |
| 2019/0137119 | A1* | 5/2019 | Koike | F24F 1/56 |
| 2019/0338964 | A1* | 11/2019 | Koike | F24F 1/12 |

FOREIGN PATENT DOCUMENTS

| | | | | |
|---|---|---|---|---|
| JP | S58-111863 | U | | 7/1983 |
| JP | 2011-158137 | A | | 8/2011 |
| JP | 2013-113563 | A | | 6/2013 |
| JP | 2014-043977 | A | | 3/2014 |
| JP | 2014-115005 | A | | 6/2014 |
| JP | 2016038175 | A | | 3/2016 |
| JP | 2017-187223 | A | | 10/2017 |
| JP | 2017-194229 | A | | 10/2017 |
| JP | 2019132544 | A | * | 8/2019 |
| JP | 2019132549 | A | * | 8/2019 |
| WO | 2016/103448 | A1 | | 6/2016 |
| WO | 2017/183601 | A1 | | 10/2017 |

OTHER PUBLICATIONS

Written Opinion issued in International Application No. PCT/JP2018/043128, dated Feb. 5, 2019 (4 pages).

Notification of Reasons for Refusal issued in Japanese Patent Application No. 2018-015458, dated Jan. 29, 2019 (6 pages).

Notification of Reasons for Refusal issued in Japanese Patent Application No. 2018-015458, dated Jul. 30, 2019 (12 pages).

English translation of the International Preliminary Report on Patentability issued in corresponding International Patent Application No. PCT/JP2018/043128, dated Aug. 13, 2020 (8 pages).

Extended European Search Report issued in corresponding European Patent Application No. 18903934.0 dated Jan. 26, 2021 (6 pages).

* cited by examiner

OUTDOOR UNIT FOR AIR CONDITIONER

BACKGROUND

Technical Field

The present invention relates to an outdoor unit for an air conditioner.

Description of the Related Art

In related art, there is known a configuration that drains water, which has flowed from a heat exchanger to a bottom frame, through a drainage channel that is formed above a support portion of an installation leg in an outdoor unit for an air conditioner (for example, see PTL 1).

PATENT LITERATURE

PTL 1: Japanese Unexamined Patent Application Publication No. 2017-194229

SUMMARY

One or more embodiments of the present invention provide an outdoor unit for an air conditioner provided with a heat exchanger (10) in a casing (20). The outdoor unit includes a bottom plate (22) that defines (forms) a bottom surface of the casing (20); and an installation leg (or installation foot) (30) that supports the bottom plate (22) from below. A portion of the heat exchanger (10) is mounted on the installation leg (30).

DETAILED DESCRIPTION

Embodiments of the present invention are described.

One or more embodiments relate to an outdoor unit (1) for an air conditioner. The air conditioner is, for example, a multiple-type air conditioner configured by connecting a plurality of indoor units (not illustrated) to one outdoor unit (1) via connection pipes. The outdoor unit (1) for the air conditioner includes, for example, a plurality of outdoor units (1) installed side by side in an outdoor environment. A plurality of indoor units are connected to each of the plurality of outdoor units (1).

The air conditioner provided with the outdoor unit (1) according to one or more embodiments performs cooling and heating of an indoor space, for example, an office. The subject space where the air conditioner performs air conditioning is not limited to a space in a room, such as an office or a house, and may be, for example, a space in a warehouse that stores products or a working space where products are handled (for example, clean room).

General Structure of Outdoor Unit

A configuration of the outdoor unit (1) is described. In the following description, "up", "down", "left", "right", "front", and "rear" represent the directions indicated in FIG. 1 unless otherwise noted.

Figure 1:
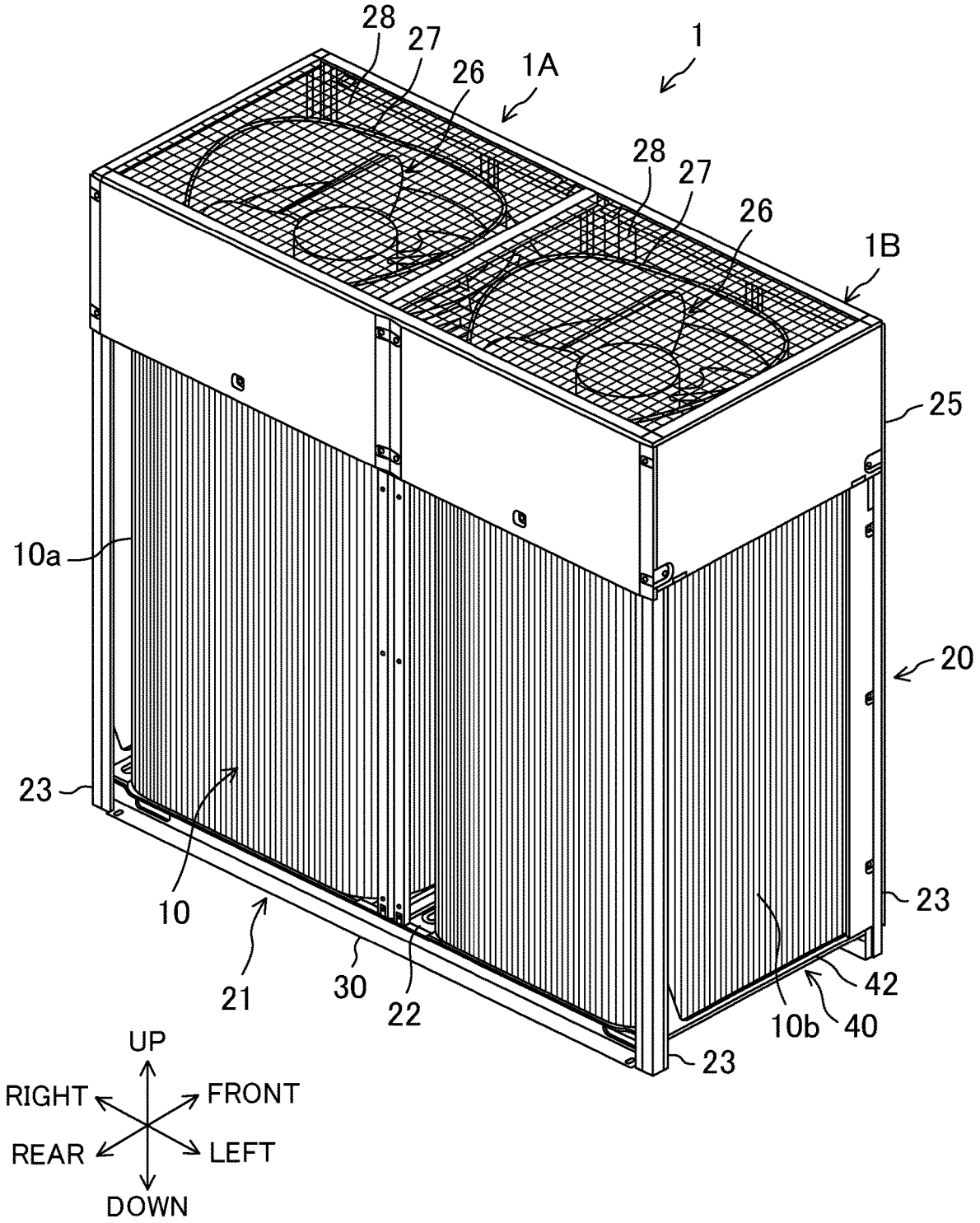
FIG. 1 is a perspective view of an outdoor unit according to one or more embodiments, when viewed from a rear surface side.

As illustrated in FIG. 1, the outdoor unit (1) includes a first unit (1A) located on the right side and a second unit (1B) located on the left side when viewed from the front surface side. The first unit (1A) and the second unit (1B) are integrated.

The outdoor unit (1) includes a vertical rectangular-parallelepiped casing (20). The casing (20) houses therein components of a refrigerant circuit. The casing (20) includes a base member (21), a support (23), and a fan module (25) which are combined with one another.

The base member (21) defines a bottom part of the casing (20). The base member (21) includes a rectangular bottom plate (22), long installation legs (or installation feet) (30) that each are fixed to a front edge portion or a rear edge portion of the bottom plate (22) and support the bottom plate (22) from below, and side stays (40) that each are fixed to a left edge portion or a right edge portion of the bottom plate (22). The support (23) includes four supports (23) provided at four corners of the base member (21) and extending in the up-down direction ("height direction") of the outdoor unit (1). The details of the base member (21) will be described later.

The fan module (25) defines an upper part of the casing (20). The fan module (25) is located above the supports (23). The fan module (25) is a group in which a substantially rectangular-parallelepiped box having openings in an upper surface, a lower surface, and a front surface thereof houses a pair of left and right fans (26) and a pair of left and right bell mouths (27). The fan module (25) includes blow-out grills (28) at the opening in the upper surface.

The fan module (25) houses the fans (26) each having a center axis of rotation extending in the up-down direction to blow out the air upward. Although not illustrated, a fan motor is provided below each of the fans (26). When the fans (26) are rotated, the air is sucked into the casing (20) from the outside of the casing (20) through a heat exchanger (10). The sucked air is blown out upward from the fan module (25) by the fans (26).

The front surface of the casing (20) is covered with a front-surface panel (not illustrated). The front-surface panel is provided to extend from the installation legs (30) to an upper end of the fan module (25).

Figure 2:
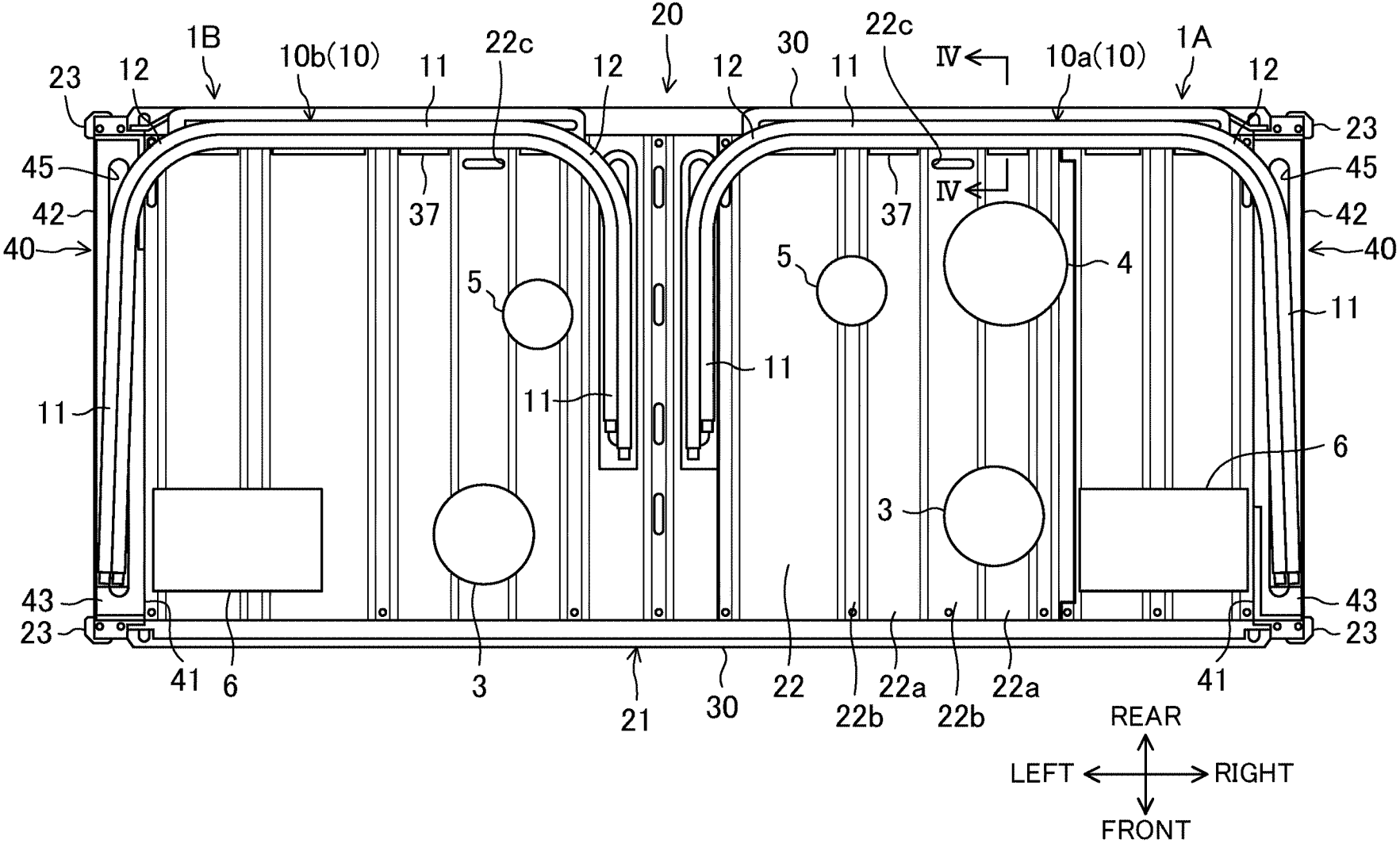
FIG. 2 is a plan view of a configuration of a base member according to one or more embodiments.

As illustrated in FIG. 2, the outdoor unit (1) is provided with components including component devices of a refrigerant circuit including a compressor (3), the heat exchanger (10), an outdoor expansion valve (not illustrated), an accumulator (4), and an oil separator (5); and control devices (such as an electric-component box (6)) housing electronic components for controlling the refrigerant circuit. Each of the indoor units is provided with devices, such as an indoor expansion valve and an indoor heat exchanger.

The heat exchanger (10) is provided in the casing (20). The heat exchanger (10) includes a first heat exchanger (10*a*) provided in the first unit (1A), and a second heat exchanger (10*b*) provided in the second unit (1B). Each heat exchanger (10) includes three-surface plate-shaped heat exchange portions (11) and bent portions (12) between the respective heat exchange portions (11), and has a U-like shape in plan view.

Although the details are omitted, the heat exchanger (10) is a heat exchanger in which end portions of a plurality of flat tubes arranged in parallel with one another and extending in the horizontal direction are connected to a header collective tube. Multiple fins are attached to each flat tube at a small pitch. Each heat exchanger (10) is a multiple-row heat exchanger in which the flat tubes are arrayed in two rows.

Base Member

The base member (21) includes the bottom plate (22), the installation legs (30), and the side stays (40). The bottom plate (22) is formed of a corrugated plate-shaped member in which mountain portions (22*a*) and valley portions (22*b*) are alternately formed in the left-right direction ("length direction") of the outdoor unit (1).

Figure 3:
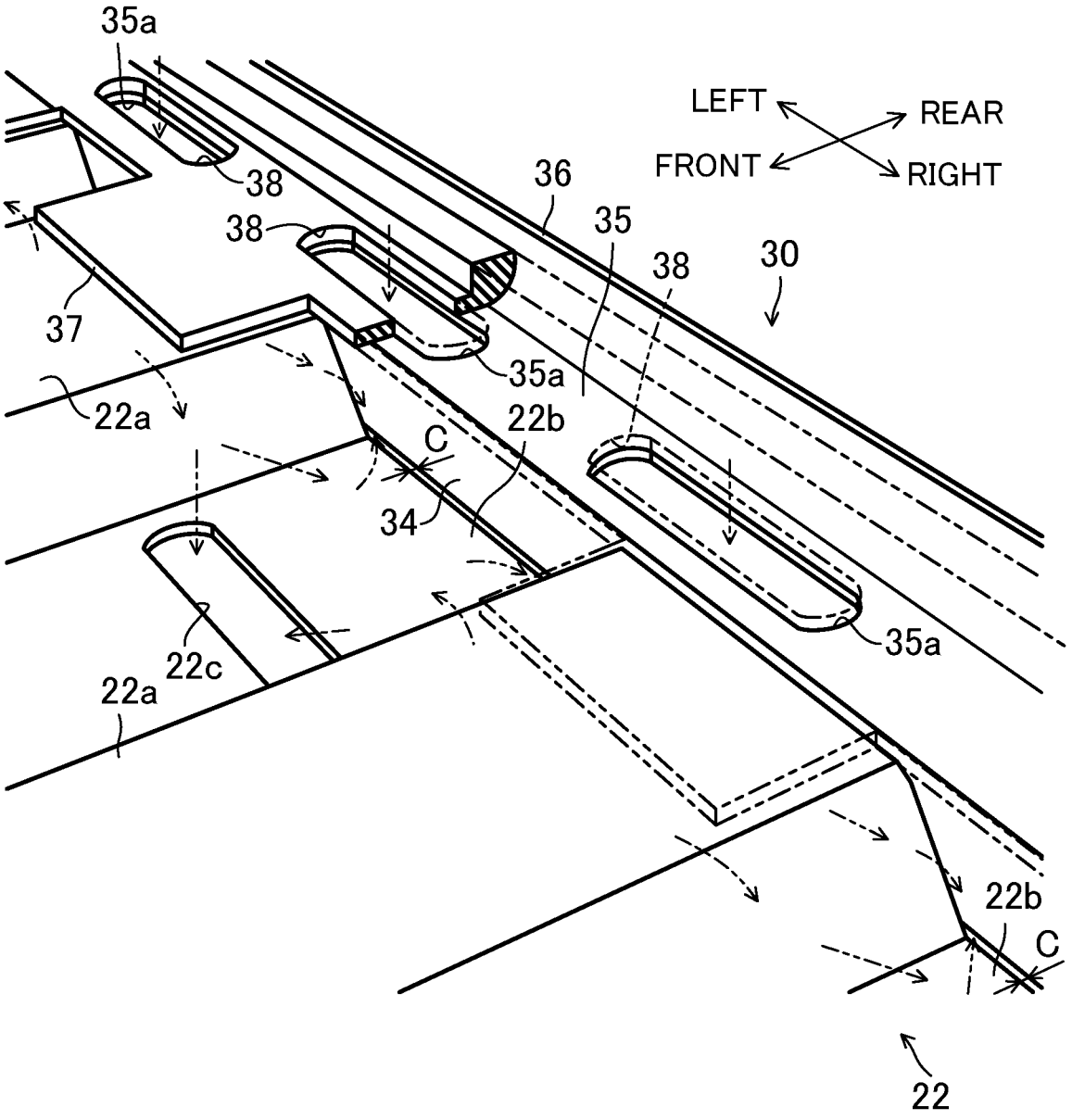
FIG. 3 is a perspective view of configurations of a bottom plate and an installation leg according to one or more embodiments.
Figure 4:
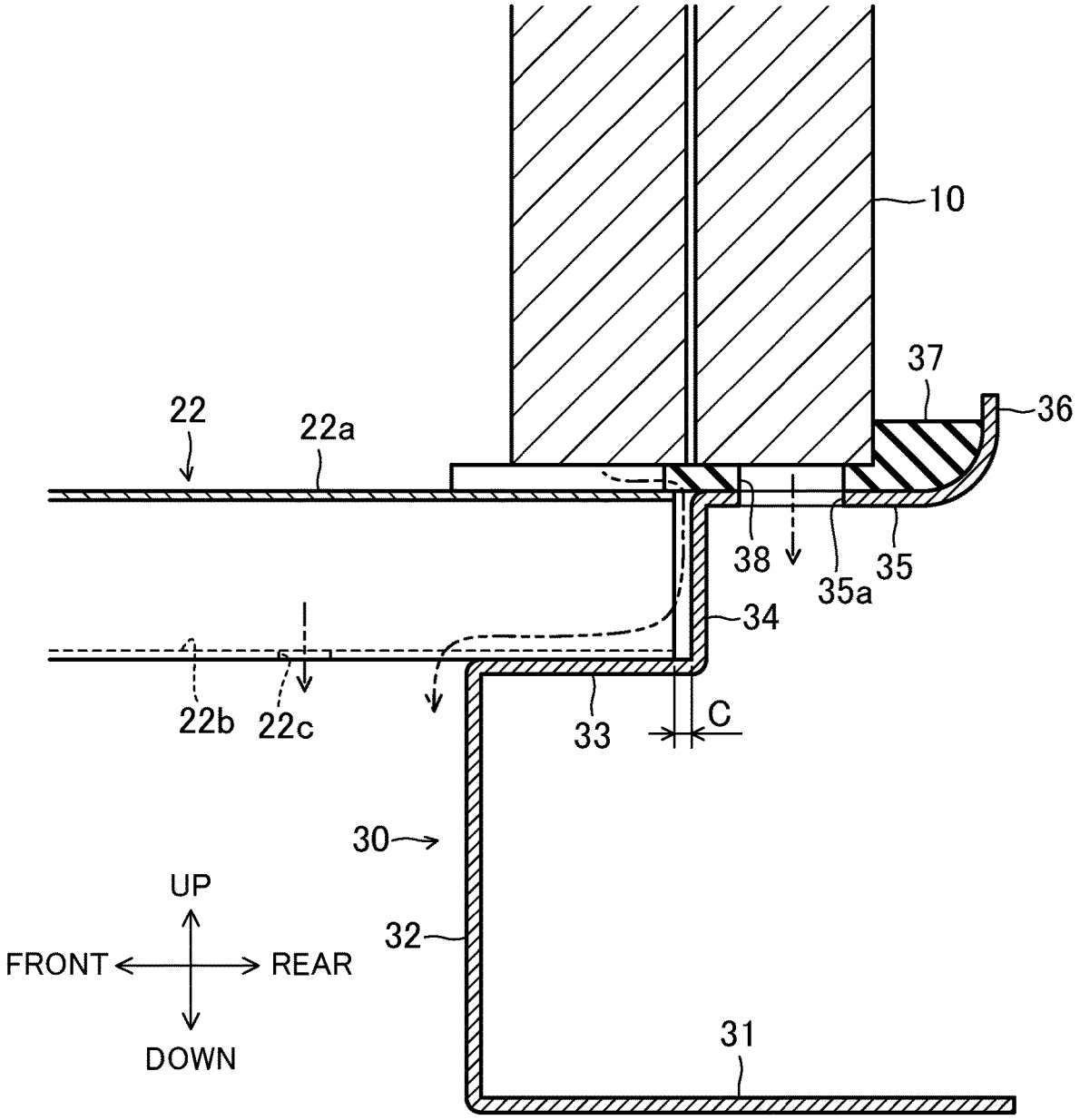
FIG. 4 is a sectional view taken along arrow IV-IV in FIG. 2.

As illustrated in FIGS. 3 and 4, each of the valley portions (22*b*) is a portion having a substantially flat surface and located at the lowermost position of the bottom plate (22). At least one of the valley portions (22*b*) has a drainage hole (22*c*) at a position near the heat exchanger (10). Accordingly, while the water flowing from the heat exchanger (10) most likely remains in the valley portion (22*b*), the water can be drained through the drainage hole (22*c*).

Each of the mountain portions (22*a*) is a portion protruding upward from the corresponding valley portion (22*b*). The mountain portion (22*a*) includes a portion that defines an inclined surface extending upward from the valley portion (22*b*), and a portion that defines a substantially flat surface continuing from the portion that defines the inclined surface and located above the valley portion (22*b*).

Each of the installation legs (30) includes a fixed portion (31) that is fixed to an installation surface, a vertical portion (32) that extends upward from an end portion on one side in the front-rear direction ("width direction") of the fixed portion (31), a support portion (33) that supports from below an end portion of the bottom plate (22) on a side on which the mountain portion (22*a*) and the valley portion (22*b*) are viewed (in this case, the front-rear direction), a wall portion (34) that is located on the outer side of one of a front end portion and a rear end portion of the bottom plate (22) and that extends upward from the support portion (33), a mount portion (35) that extends outward from an upper end of the wall portion (34) and on which the heat exchanger (10) is mounted, and an end edge portion (36) that extends upward from an end edge on the outer side of the mount portion (35).

The valley portion (22*b*) of the bottom plate (22) is mounted on the support portion (33). A predetermined gap (C) is provided between an end edge of the bottom plate (22) mounted on the support portion (33) and an end edge on the inner side of the mount portion (35) of the installation leg (30). The gap (C) defines a drainage channel for causing water adhering to the mountain portion (22*a*) of the bottom plate (22) to flow to the support portion (33).

The support portion (33) is in contact with the valley portion (22*b*) of the bottom plate (22) and supports the installation leg (30) from below. In this case, a space is formed between the support portion (33) and the mountain portion (22*a*) of the bottom plate (22). The space communicates with the gap (C). Thus, the gap (C) functions as a drainage channel.

The water guided to the support portion (33) through the gap (C) flows to a position below the bottom plate (22) through the space between the mountain portion (22*a*) of the bottom plate (22) and the support portion (33). Thus, the water unlikely flows to the outer side of the casing (20).

The mount portion (35) of the installation leg (30) has a plurality of drainage holes (35*a*) that extend through the mount portion (35) in the up-down direction and that are spaced apart in the left-right direction. An upper surface of the mount portion (35) of the installation leg (30) is substantially flush with an upper surface of the mountain portion (22*a*) of the bottom plate (22) mounted on the support portion (33). An elastic member (37) is arranged to extend from the mountain portion (22*a*) of the bottom plate (22) to the mount portion (35) of the installation leg (30).

The elastic member (37) is made of, for example, a rubber material, and has a shape from which a portion corresponding to the valley portion (22*b*) of the bottom plate (22) in plan view is cut and removed. The elastic member (37) has a through hole (38) formed at a position corresponding to the mount portion (35).

The heat exchanger (10) is arranged to extend from the mountain portion (22*a*) of the bottom plate (22) to the mount portion (35) of the installation leg (30) via the elastic member (37).

In the outdoor unit (1), the heat exchanger (10) is frosted during heating operation. When defrosting operation is performed to defrost the heat exchanger (10), the water generated due to defrosting flows and runs down from the heat exchanger (10). Since the heat exchanger (10) is mounted on the mount portion (35) of the installation leg (30), the heat of the heat exchanger (10) is transferred to the installation leg (30) and heats the installation leg (30). Accordingly, the water flowing from the heat exchanger (10) to the installation leg (30) is not frozen.

Moreover, as illustrated in FIGS. 3 and 4, the flow of water is indicated by imaginary arrow lines. The water flowing from the heat exchanger (10) is drained to the outside of the casing (20) from the drainage hole (35*a*) formed in the mount portion (35) of the installation leg (30), the drainage hole (22*c*) formed in the valley portion (22*b*) of the bottom plate (22), and the drainage channel communicating with the gap (C) and defined by the wall portion (34) of the installation leg (30), the support portion (33), and the mountain portion (22*a*) of the bottom plate (22).

Each of the side stays (40) is disposed to bridge between the pair of installation legs (30) at one of both end portions in the left-right direction. Each of the side stays (40) includes a mount portion (41) that defines a bottom surface of the casing (20) and on which the heat exchanger (10) is mounted, and an outer wall portion (42) that extends upward along an outer edge of the mount portion (41). The side stay (40) has both end portions in the front-rear direction coupled to the supports (23).

As illustrated in FIG. 2, the heat exchange portion (11) on the right side of the first heat exchanger (10*a*) is mounted on the mount portion (41) of the side stay (40) on the right side via an elastic member (43). The mount portion (41) of the side stay (40) on the right side has a plurality of long drainage holes (45) that extend in the front-rear direction and that are arranged in the front-rear direction.

The heat exchange portion (11) on the left side of the second heat exchanger (10*b*) is mounted on the mount portion (41) of the side stay (40) on the left side via an elastic member (43). The mount portion (41) of the side stay (40) on the left side has a plurality of long drainage holes (45) that extend in the front-rear direction and that are arranged in the front-rear direction.

Accordingly, the water flowing from the heat exchanger (10) is drained from the drainage holes (45) formed in the mount portion (41) of the side stay (40).

An outdoor unit (1) for an air conditioner according to one or more embodiments is provided with a heat exchanger (10) in a casing (20). The outdoor unit (1) includes a bottom plate (22) that defines a bottom surface of the casing (20); and an installation leg (30) that supports the bottom plate (22) from below. A portion of the heat exchanger (10) is mounted on the installation leg (30).

In one or more embodiments, the portion of the heat exchanger (10) is mounted on the installation leg (30) that supports the bottom plate (22) from below. Accordingly, the heat of the heat exchanger (10) is transferred to the installation leg (30) and heats the installation leg (30). Water flowing to the installation leg (30) from the heat exchanger (10) is not frozen, thereby increasing drainage performance.

Moreover, in the outdoor unit (1) for the air conditioner according to one or more embodiments, the installation leg (30) has a hole (35*a*) that extends through the installation leg (30) in an up-down direction.

In one or more embodiments, since the installation leg (30) has the drainage hole (35*a*), the water flowing from the heat exchanger (10) to the installation leg (30) can be drained from the drainage hole (35*a*).

In the outdoor unit (1) for the air conditioner according to one or more embodiments, a mount surface of the installation leg (30) for the heat exchanger (10) is substantially flush with an upper surface of the bottom plate (22), a predetermined gap (C) is provided between an end edge of the bottom plate (22) and an end edge of the mount surface of the installation leg (30), and the heat exchanger (10) is mounted to extend from the bottom plate (22) to the installation leg (30).

In one or more embodiments, the mount surface of the installation leg (30) for the heat exchanger (10) is substantially flush with the upper surface of the bottom plate (22). The heat exchanger (10) is mounted to extend from the bottom plate (22) to the installation leg (30). Moreover, since the gap is provided between the end edge of the bottom plate (22) and the end edge of the mount surface of the installation leg (30), the water flowing from the heat exchanger (10) can be drained from the gap.

In the outdoor unit (1) for the air conditioner according to one or more embodiments, the bottom plate (22) is constituted of a corrugated plate-shaped member in which a mountain portion (22*a*) and a valley portion (22*b*) are formed to be arranged in a left-right direction; and the installation leg (30) includes a support portion (33) that supports from below an end portion of the bottom plate (22) on a side on which the mountain portion (22*a*) and the valley portion (22*b*) are viewed, a wall portion (34) that is located on an outer side of the end portion of the bottom plate (22) and that extends upward from the support portion (33), and a mount portion (35) that extends outward from an upper end of the wall portion (34) and on which the heat exchanger (10) is mounted.

In one or more embodiments, the installation leg (30) includes the support portion (33), the wall portion (34), and the mount portion (35). The support portion (33) supports from below the end portion of the bottom plate (22) on the side on which the mountain portion (22*a*) and the valley portion (22*b*) are viewed. The wall portion (34) is located on the outer side of the end portion of the bottom plate (22). Accordingly, the water flowing from the heat exchanger (10) mounted on the mount portion (35) can be drained from a drainage channel that is defined by the wall portion (34), the support portion (33), and the mountain portion (22*a*) of the bottom plate (22).

Additional Embodiments

The above-described embodiments may also be configured as follows.

Modification

In the above-described embodiments, the outdoor unit (1) in which the first unit (1A) and the second unit (1B) disposed on the left and right sides are integrated has been described; however, the outdoor unit (1) according to one or more embodiments may be constituted of only one unit. That is, in the above-described embodiments, the outdoor unit (1) is provided with the two heat exchangers (10*a*, 10*b*); however, the outdoor unit (1) may be constituted of only one heat exchanger (10). In such a case, the number and size of at least one heat exchanger may be determined in accordance with the performance of the heat exchanger of one or more embodiments.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

INDUSTRIAL APPLICABILITY

As described above, one or more embodiments of the present invention are useful for an outdoor unit for an air conditioner.

REFERENCE SIGNS LIST

1 outdoor unit
10 heat exchanger
20 casing
22 bottom plate
22*a* mountain portion
22*b* valley portion
30 installation leg
33 support portion
34 wall portion
35 mount portion
35*a* drainage hole
C gap

The invention claimed is:

1. An outdoor unit for an air conditioner comprising:
a casing comprising a bottom plate that defines a bottom surface of the casing;
a heat exchanger disposed in the casing; and
an installation foot that supports the bottom plate from below, wherein the installation foot comprises:
a support portion that supports from below an end portion of the bottom plate;
a wall portion disposed on an outer side of the end portion of the bottom plate and that extends upward, in a height direction of the outdoor unit, from the support portion;
a mount portion that extends from an upper end of the wall portion; and
an end edge portion that extends upward, in the height direction, from an edge end on an outer side of the mount portion,
the heat exchanger is mounted on the mount portion, and
the mount portion has a hole that extends through the mount portion in the height direction.

2. The outdoor unit for the air conditioner according to claim 1, wherein the bottom plate is a corrugated plate comprising a mountain portion and a valley portion that arranged in a length direction or a width direction of the outdoor unit, and the support portion supports the end portion of the bottom plate on a side from which the mountain portion and the valley portion can be viewed.

3. The outdoor unit for the air conditioner according to claim 1, further comprising:

an elastic member disposed between the mount portion and the heat exchanger.

4. An outdoor unit for an air conditioner comprising:

a casing comprising a bottom plate that defines a bottom surface of the casing;

a heat exchanger disposed in the casing;

an installation foot that supports the bottom plate from below;

an elastic member, wherein the installation foot comprises:

a support portion that supports from below an end portion of the bottom plate;

a wall portion disposed on an outer side of the end portion of the bottom plate and that extends upward, in a height direction of the outdoor unit, from the support portion; and a mount portion that extends from an upper end of the wall portion, the heat exchanger is mounted on the mount portion, the mount portion has a hole that extends through the mount portion in the height direction, the elastic member is disposed between the mount portion and the heat exchanger, and the elastic member has a hole that overlaps the hole of the mount portion in plan view and that extends through the elastic member in the height direction.

5. An outdoor unit for an air conditioner comprising:

a casing comprising a bottom plate that defines a bottom surface of the casing;

a heat exchanger disposed in the casing; and an installation foot that supports the bottom plate from below, wherein a portion of the heat exchanger is mounted on a mount surface of the installation foot, the mount surface is flush with an upper surface of the bottom plate, the heat exchanger is mounted to straddle the bottom plate and the installation foot, the mount surface has a hole that extends through the mount surface in a height direction of the outdoor unit, and an end edge portion of the installation foot extends upward, in the height direction, from an edge end on an outer side of the mount surface.

6. The outdoor unit for the air conditioner according to claim 5, wherein a predetermined gap is disposed between an end edge of the bottom plate and an end edge of the mount surface.

* * * * *